US005177542A

United States Patent [19]

Lubberts

[11] Patent Number: 5,177,542

[45] Date of Patent: Jan. 5, 1993

[54] METHOD OF XEROPRINTING

[75] Inventor: Cor Lubberts, Webster, N.Y.

[73] Assignee: Eastman Kodak Company, Rochester, N.Y.

[21] Appl. No.: 789,212

[22] Filed: Oct. 7, 1991

[51] Int. Cl.[5] ..... G03G 15/14

[52] U.S. Cl. ..... 355/271; 346/153.1; 346/157; 355/200; 355/211; 355/272; 355/327

[58] Field of Search ..... 355/200, 202, 46, 32, 355/271, 272, 326, 327, 211, 212, 213; 101/178, 216; 346/153.1, 157, 160

[56] References Cited

U.S. PATENT DOCUMENTS

| | | | |
|---|---|---|---|
| 2,576,047 | 11/1951 | Schaffert . | |
| 3,063,368 | 11/1962 | Liessen | 101/178 |
| 3,615,128 | 10/1971 | Bhagat . | |
| 3,667,840 | 6/1972 | Engel et al. . | |
| 3,695,757 | 10/1972 | Gregory | 355/200 |
| 3,827,803 | 8/1974 | Shelffo et al. . | |
| 3,954,463 | 5/1976 | Bhagat | 101/467 X |
| 3,966,316 | 6/1976 | Pfeifer et al. . | |
| 4,032,229 | 6/1977 | Tani et al. . | |
| 4,056,315 | 11/1977 | Ariyama et al. . | |
| 4,114,998 | 9/1978 | Shimizu et al. . | |
| 4,179,211 | 12/1979 | Kimura et al. | 355/211 |
| 4,253,758 | 3/1981 | Cormier . | |
| 4,286,031 | 8/1981 | Kuehnle et al. . | |
| 4,357,093 | 11/1982 | Caudill et al. | 355/200 |
| 4,376,579 | 3/1983 | Wakao . | |
| 4,546,060 | 10/1985 | Miskinis et al. . | |
| 4,571,071 | 2/1986 | Bothner . | |
| 4,586,434 | 5/1986 | Tokuno et al. | 101/178 |
| 4,598,992 | 7/1986 | Landa et al. . | |
| 4,661,429 | 4/1987 | Molaire et al. . | |
| 4,664,499 | 5/1987 | Alston . | |
| 4,728,987 | 3/1988 | Diola et al. . | |
| 4,835,570 | 5/1989 | Robson | 355/272 X |
| 4,914,477 | 4/1990 | Young et al. . | |
| 4,987,455 | 1/1991 | Lubberts | 355/271 |
| 4,990,969 | 2/1991 | Rapkin | 355/327 |
| 5,016,062 | 5/1991 | Rapkin | 355/327 |
| 5,052,120 | 10/1991 | Lubberts . | |
| 5,081,507 | 1/1992 | Monkelbaan et al. | 355/327 X |
| 5,111,744 | 5/1992 | Wieland | 101/216 |

FOREIGN PATENT DOCUMENTS 0261352 11/1986 Japan .

OTHER PUBLICATIONS

Schaffert, R. M., Electrophotography, 1980, 2nd Edition, pp. 209–210.

*Primary Examiner*—Joan H. Pendegrass
*Assistant Examiner*—Matthew S. Smith
*Attorney, Agent, or Firm*—David A. Howley

[57] ABSTRACT

A method of xeroprinting in which a master sheet is secured to a drum to create a drum-sheet unit. The drum-sheet unit is installed in a master-creating apparatus where a xeroprinting master is created on the master sheet. The drum-sheet unit is then removed from the master-creating apparatus and installed in a xeroprinting apparatus. The xeroprinting apparatus forms a visible image on the xeroprinting master. The visible image is transferred and fixed to a receiver sheet. This method may be used to make color prints. Several color separation xeroprinting masters are created and the toned images created from them are superimposed in registered alignment with each other onto a receiver sheet to create a multicolor print.

7 Claims, 3 Drawing Sheets

METHOD OF XEROPRINTING

TECHNICAL FIELD OF THE INVENTION

The present invention relates to xeroprinting. The invention is especially useful in obtaining high quality color prints from a multicolor xeroprinting machine.

BACKGROUND ART

Xeroprinting, as described by Schaffert, R.M., in *Electrophotography* (2nd Edit., Focal Press, 1980) at pp. 209–210, is the name given to an electrostatic printing process designed to print many copies of an original from a master plate or cylinder. The printing master or plate consists of a metal sheet or cylinder on which is imprinted an image in the form of a thin insulating coating. The image areas consist of insulating material and the background areas are bare metal.

When the master plate is electrically charged by passing it under a corona charging unit, the charges deposited on the insulated image remain on the image surface, and those deposited on the bare metal areas are conducted away to ground. This forms an electrostatic image corresponding to the insulated areas. The image is then developed with toner which is transferred and fused to a receiver sheet.

U.S. Pat. No. 4,914,477, issued to Young et al discloses an apparatus which may be used to create xeroprinting masters. An electrophotographic web, having a photoconductive layer, a conductive layer and a support layer, is charged at a charging station and exposed at an exposing station to create an electrostatic image on the web. This image is toned at a toning station with electrically insulating toner to create a toner image. The toner image is then transferred and fused to a receiver sheet having an outer conductive layer. The result is a xeroprinting master which may be used in a xeroprinting apparatus. Color separation xeroprinting masters may be created by exposing the web according to color separation image data and developing the resultant electrostatic images with the insulating toner.

The Young apparatus is intended to be part of a system including separate master-making and master-using machines. The master-making machine would be slow and electronically controlled, producing very high quality xeroprinting masters. The master-using machine would be fast and heavy-duty. This system allows masters for one printer job to be made while another job is being printed.

U.S. Pat. No. 2,576,047 to Schaffert discloses a xeroprinting apparatus which is capable of utilizing the xeroprinting master created by the Young et al apparatus. A rotatably mounted drum has a xeroprinting master (called a "plate" in Schaffert) flexed around and attached to the drum. The xeroprinting master is held to the drum by conventional means and the conductive layer of the master is electrically connected to the drum which is ground. A uniform charge is applied to the master. This charge remians only on the insulating toner. The resultant electrostatic image is developed with toner to create a visible image. This visible image is transferred and fused to a receiver sheet.

The apparatus disclosed in Schaffert may be adapted to produce multicolor prints from a multicolor original. Four color separation xeroprinting masters, representing red, green, blue and black light images of a multicolor original, are each secured to a drum. Each master is charged, and the resultant electrostatic image is developed with a certain color toner. The red master is developed with cyan toner, the green master is developed with magenta toner, blue master is developed with yellow toner and the black master is developed with black toner. The four toned images are transferred in superimposed registration with one another to a receiver sheet to form a multicolor print thereon.

A problem with this form of xeroprinting is that if the xeroprinting master is secured to the drum askew, any copies made from the master will also have images which are askew from the edges of the copy. Additionally, the master sheet may be deformed by overtensioning it when the master is secured to the drum. This will cause lines of image information to spread apart as well as cause the image information in individual lines to crowd together. This problem is compounded in a multicolor xeroprinter. In the prior art, a front and side edge of each master is used to register each master in the xeroprinting apparatus. That registration must be accurate enough to obtain a final multicolor print in which the colors are tightly in register. If each of the color separation masters are not secured to their respective drums in exactly the same orientation, color misregistration will result. Correcting for skew color misregistration will involve the very difficult task of realigning the master sheets on the drum because skew misregistration cannot be corrected by reorienting the drums themselves.

SUMMARY OF THE INVENTION

In accordance with the invention, there is provided a method of xeroprinting in which a master sheet is secured to a drum to create a drum-sheet unit. A xeroprinting master representing image information to be reproduced is then created on the master sheet in a master-creating apparatus. The drum-sheet unit is removed from the master-creating apparatus and installed in a xeroprinting apparatus. Although the master-creating apparatus and xeroprinting apparatus are described as separate, it must be emphasized that the two apparatus may be located within one machine. A plurality of xeroprints are created from the xeroprinting master by the xeroprinting apparatus.

In a preferred embodiment of the invention, at least two master sheets are secured to at least two drums (one master sheet being secured to each drum) to create at least two drum-sheet units. A color-separation xeroprinting master is created on each master sheet in the master-creating apparatus. Each drum-sheet unit is removed from the master-creating apparatus and installed in the xeroprinting apparatus. A plurality of multicolor xeroprints are created from the color-separation xeroprinting masters by the xeroprinting apparatus.

The xeroprinting apparatus is intended to create a large number of multicolor prints (e.g., 2000–8000 prints). Even with the xeroprinting machine operating at the rapid rate of one color print per second, it will still take in excess of 30 minutes to finish a printing job. This allows plenty of time to create the next set of color separation xeroprinting masters in the master-creating apparatus for the next printing job. The master-creating apparatus will take about five minutes to create each master. Through the use of electronic controls and due to the amount of time available to create each master, high quality xeroprinting masters are created.

This method of xeroprinting eliminates the importance of the master sheet securing process, which is especially critical in the two machine concept of Young. This is because the master sheet is secured to the drum before a xeroprinting master is created on the master sheet. Even if the master sheet is secured to the drum askew or the master sheet is deformed due to overtensioning it in the securing step, the lines of image information imparted to the master sheet will be parallel to the axis of the drum and equally spaced apart because the drum is always positioned in the master-creating apparatus in the same orientation. It is more important for the image information to be aligned parallel to the axis of rotation of the drum than to be aligned to an edge of the master sheet. This is especially true when making multicolor copies. In the prior art, to adjust for skew color misregistration, the master sheets themselves must be realigned on the drums, in addition to having to reorient the drums themselves to correct for in-track and cross-track misregistration. Skew misregistration cannot be corrected by realigning the drums because the drum axes must always remain parallel to each other. Additionally, prior art devices cannot make corrections for master sheet deformation due to overtensioning of the master during the securing step. With the present invention only the drums may need to be adjusted to correct for in-track and cross-track color misregistration. It is much easier to only have to adjust the drums for in-track and cross-track registration than to also have to reorient a master sheet on a drum to correct for skew misregistration.

DETAILED DESCRIPTION OF THE BEST MODE

In the present invention, two apparatus are utilized to reproduce image information. A master-creating apparatus, which operates at a slow rate (e.g., taking about five minutes to create one color separation xeroprinting master), produces extremely high quality xeroprinting masters. A xeroprinting apparatus utilizes these masters to rapidly create a large number of multicolor prints. While a printing job is running in the xeroprinting apparatus, the master-creating apparatus is forming the next set of color-separation xeroprinting masters.

Figure 1:
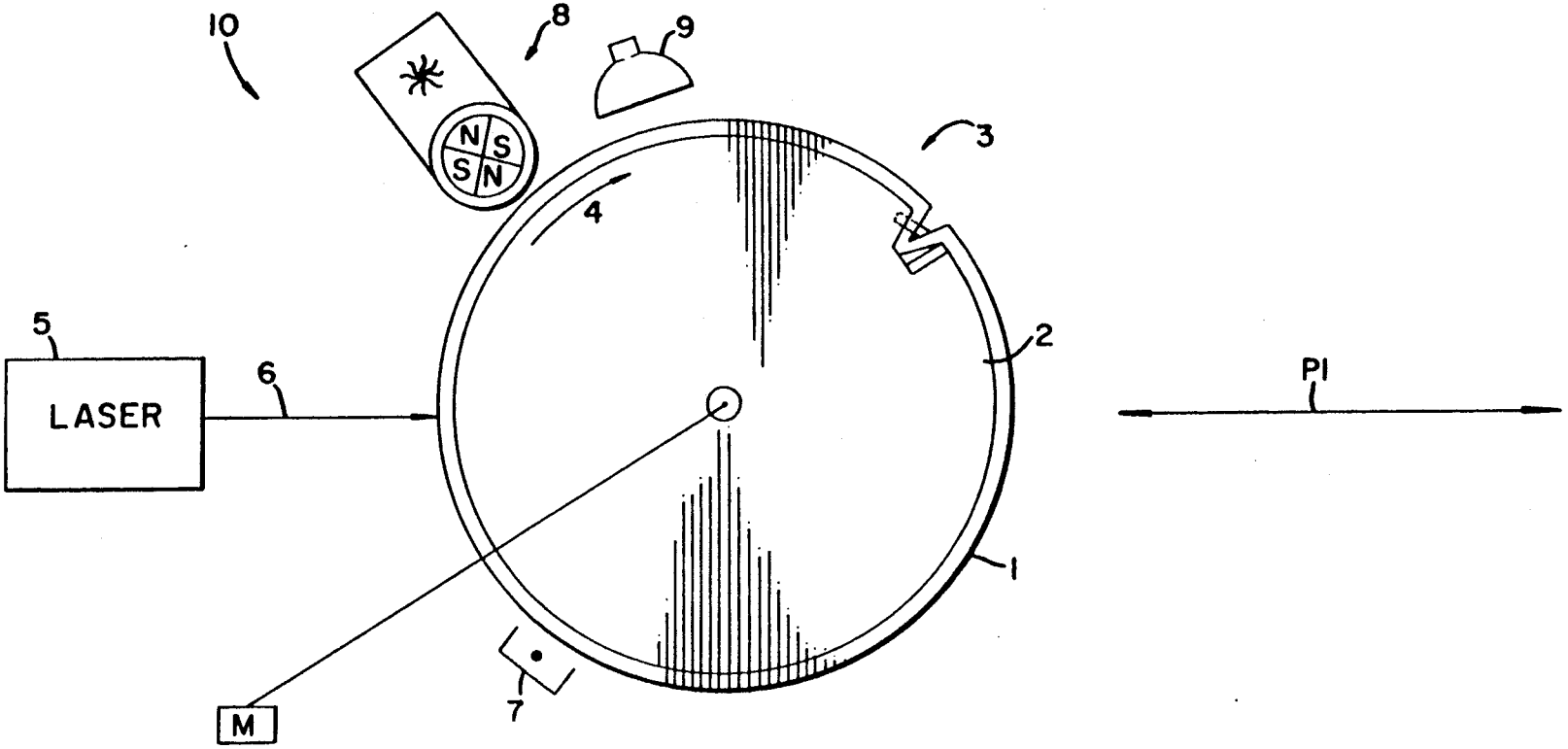
FIG. 1 is a side schematic illustrating one method of creating a master image on a master sheet.

Referring to the drawings, FIG. 1 is a side schematic illustrating one method of creating a xeroprinting master. A master sheet 1 is wrapped around a drum 2 and secured to drum 2 to create a drum-sheet unit 3. Means for securing master sheet 1 to drum 2 and means for properly tensioning master sheet 1 are disclosed in U.S. Pat. No. 5,052,120, which is incorporated herein by reference. Master sheet 1 has an outer photoconductive layer coated on a grounded conductive layer which is carried by a suitable support.

After master sheet 1 is secured to drum 2 and properly tensioned, drum-sheet unit 3 is installed into a master-creating apparatus 10 along path P1 (drum 2 may be located in master-creating apparatus 10 prior to having master sheet 1 secured to drum 2). An apparatus for installing and securing drum-sheet unit 3 into master-creating apparatus 10 is disclosed in U.S. Pat. No. 4,598,992, issued in the name of Landa et al, which is incorporated herein by reference. This apparatus may also be used to remove the drum-sheet unit from the master-creating apparatus. Drum-sheet unit 3 is rotated in a direction 4 at a constant velocity by a motor M.

A DC corona charger 7 imparts a uniform electrical charge to the surface of the photoconductive layer. Next, a laser diode 5 emits a laser beam 6, which strikes the surface of master sheet 1. Laser beam 6 sweeps master sheet 1 in a direction perpendicular to the direction of travel of master sheet 1. Laser beam 1 intensity modulated according to color separation image data from an original to be reproduced. For example, laser beam 1 will be modulated according to red color separation image data. Those areas of the photoconductive layer exposed to laser beam 6 discharge through the grounded conductive layer, leaving an electrostatic latent image.

The latent image is then developed with an electrically insulating toner by a magnetic brush applicator 8. Such a magnetic brush is disclosed in U.S. Pat. No. 4,546,060, issued in the name of Miskinis et al, which is incorporated herein by reference. This results in an insulating color separation toned image which is permanently fused to master sheet 1 by a lamp fuser 9. Drum-sheet unit 3 is removed from master-creating apparatus 10 along path P1 and stored.

The above process is repeated for three more drum-sheet units 3. The only difference will be that laser beam 6 will be modulated by a separate set of color separation image data for each drum-sheet unit. One master sheet is exposed according to blue image data, another according to green image data, and the fourth master sheet is exposed according to black image data. This process will create four color separation xeroprinting masters on four drum-sheet units.

In an alternative embodiment, the outer layer of the master sheet is comprised of an acid photogenerator. Preferably the acid photogenerator is an iodonium salt. Useful acid photogenerators and iodonium salts are disclosed in U.S. Pat. No. 4,661,429, issued in the name of Molaire el al, which is incorporated herein by reference. Those areas of the iodonium salt layer exposed to the laser beam experience a great increase in conductivity, while unexposed areas remain able to hold a charge. By imagewise exposing the iodonium salt layer to a laser beam, a substantially permanent conductivity image is created in the layer. In this embodiment, only laser diode 5 is utilized. Charger 7, applicator 8 and fuser 9 are not needed.

Figure 2:
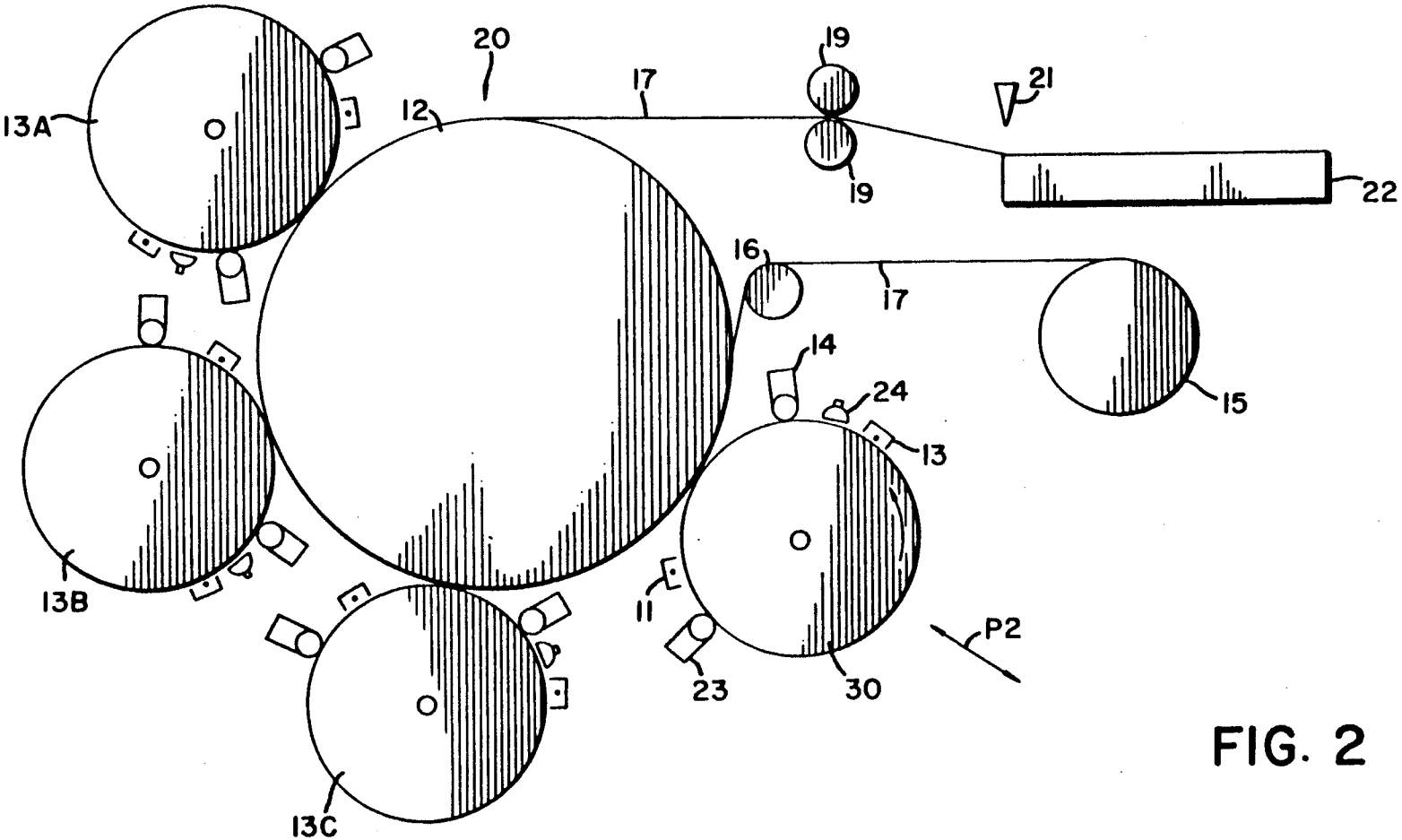
FIG. 2 is a side schematic illustrating a method of xeroprinting with four color separation master sheets.

Turning now to FIG. 2, there is shown a side schematic illustrating one method of xeroprinting utilizing the four color separation xeroprinting masters created on the photoconductive layer. Drum-sheet units 3A–D are each installed into a xeroprinting apparatus 20 along path P2 (shown only for drum-sheet unit 3D). The drum-sheet units are arranged around a process roller 12 in the xeroprinting apparatus. The apparatus disclosed in the Landa patent is also used to install and secure the drum-sheet units into the xeroprinting apparatus as well as to remove the drum-sheet units therefrom. As is well known in the prior art, the axis of rotation of the drum-sheet units must be parallel with the axis of rotation of the process roller. Each drum-sheet unit is surrounded by stations well known in the electrophotographic art. The various stations are shown for all of the drum-sheet units but will be discussed only with reference to drum-sheet unit 3D.

Drum-sheet unit 3D is rotated in a direction 11 by means known in the art such as frictional engagement with process roller 12 or by the use of a gear drive. Process roller 12 has a dielectric outer layer below which is a conductive layer connected to a voltage supply (not shown). A DC primary charger 13 applies a uniform electric charge to the surface of the xeroprinting master (master). The master is exposed to light by lamp 24. This discharges the surface of the master in all areas except where the insulating toned image is located. A color separation latent electrostatic image is left on the surface of the master. This image is developed by a magnetic brush 14 (as disclosed in Miskinis) utilizing certain color toner particles, for example, yellow. After the latent electrostatic image is developed by magnetic brush 14, there will be a color toned image on the surface of the master.

A receiver sheet 17 is fed from a receiver sheet supply 15 over a guide roller 16 and onto process roller 12. Receiver sheet 17 may be made of paper, clear plastic or any other substrate designed to receive toned images.

The color toned image on the surface of the master is transferred to receiver sheet 17 at the interface between drum-sheet unit 3D and process roller 12. Transfer is accomplished by placing a bias voltage on the conductive layer of process roller 12 of a polarity opposite that of a triboelectric charge on the toner particles. In a preferred embodiment, this bias voltage is from 100–500 volts. An electric field is created between the grounded conductive layer of the master and the conductive layer of process roller 12. This causes the toned image to transfer from the master to receiver sheet 17.

After transfer is complete, an AC detack corona 11 neutralizes any charge remaining on the master sheet. A magnetic brush cleaner 23, disclosed in U.S. Pat. No. 4,571,071 issued to Bothner, which is incorporated herein by reference, removes any residual color toner particles remaining on the master.

This same process is repeated at each of the other three drum-sheet units 3A–C. The only difference is that at each drum-sheet unit a different color toner, such as cyan, magenta or black, is used to develop the color separation latent electrostatic image. The spacing of drum-sheet units 3 about process roller 12 and the radius of the drums is such that the toned images are superimposed on top of one another on receiver sheet 17 to form a multicolor image thereon. Receiver sheet 17 continues about process roller 12 to fusing rollers 19 which permanently fuse the multicolor image to receiver sheet 17. Receiver sheet 17 is chopped into individual sheets by cutter 21 to form individual multicolor prints which are deposited in exit hopper 22. Alternatively, receiver sheet 17 may be fed onto process roller 12 as an individual sheet (e.g., 8½"×11") rather than as one continuous sheet. In this embodiment, cutter 21 would not be necessary.

For the embodiment in which the outer layer of the master sheet is comprised of iodonium salt, the above process remains the same. The only difference is that lamp 24 is not utilized. Charge will only remain on those areas of the iodonium salt layer not exposed to the laser.

Figure 3:
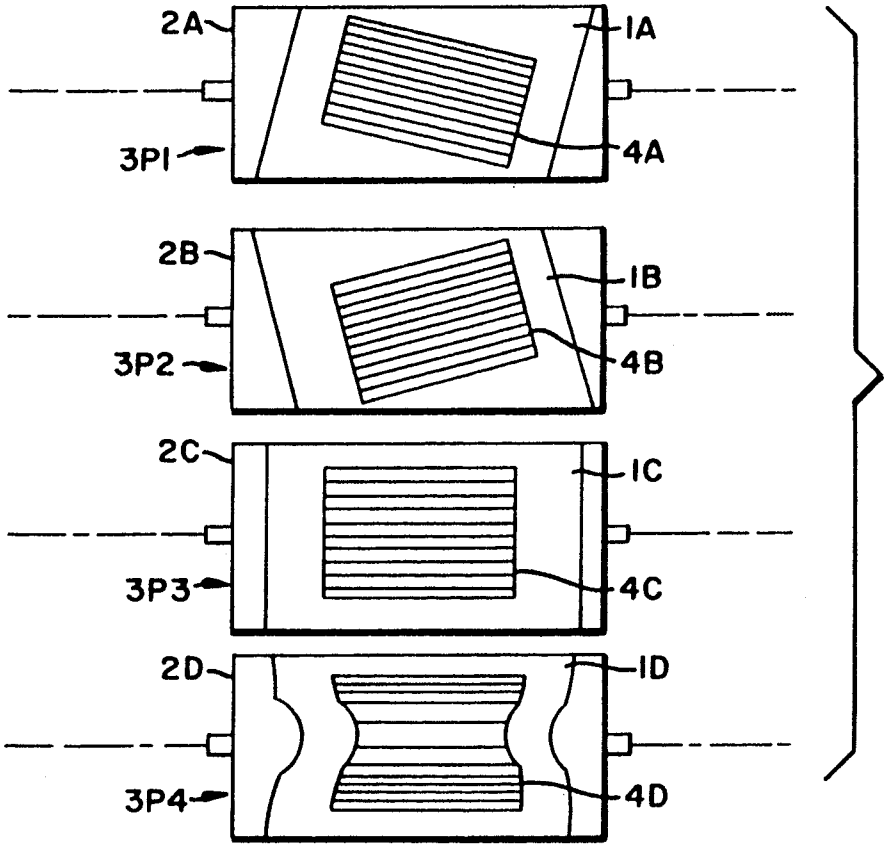
FIG. 3 PRIOR ART
FIG. 3 is a front schematic illustrating three prior art drum-sheet units.

Turning now to FIG. 3, four prior art drum-sheet units 3P1-4 are shown. Each drum-sheet unit contains a different color separation xeroprinting master. Referring to drum-sheet unit 3P1, a master sheet 1A is secured to a drum 2A. Master sheet 1A had image information 4A imparted to it before master sheet 1A was secured to drum 2A. Image information 4A is aligned with the edges of master sheet 1A but is not aligned with the axis of rotation of drum 2A. In other words, image information 4A is askew on drum 2A (the amount of skew is exaggerated for demonstration purposes). The image information on each drum is in a different orientation. For drum 3P-4 master sheet 1D was deformed when it was secured to the drum due to overtensioning. The master sheet has stretched and "necked-down". This causes the lines of image information to spread apart while causing image information in individual lines to crowd together. If drum-sheet units 3P1-4 were installed in the xeroprinting apparatus of FIG. 2, the multicolor prints created therefrom would be out of register. In order to correct for skew misregistration, the master sheets must be reoriented on their drums. It is not possible to correct for a deformed master sheet.

Figure 4:
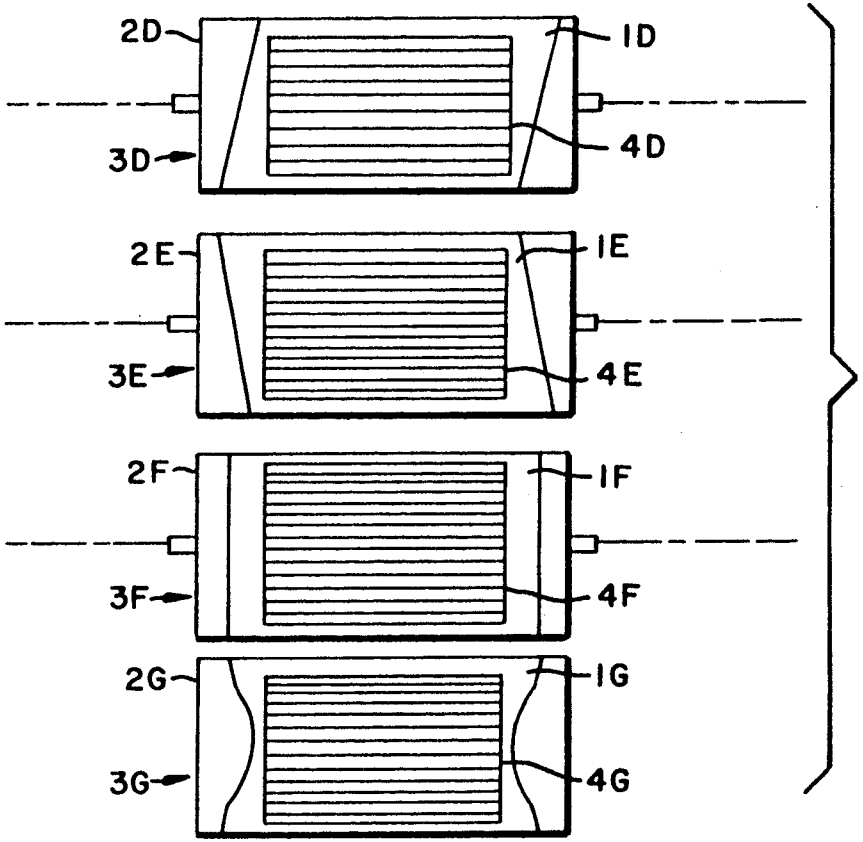
FIG. 4 is a front schematic illustrating three drum-sheet units representing the present invention.

FIG. 4 represents drum-sheet units 3D-G of the present invention. Like the drum-sheet units 3P1-3 of the prior art, the drum-sheet units 3D-F of the present invention have master sheets 1D-F located on their respective drums in various orientations. Also, master sheet 1G was deformed when secured to drum 26 due to overtensioning. However, because the master sheets were secured to their drums prior to having image information 4D-G imparted to the master sheets, the image information 4D-G is located on its respective drum in the same orientation for each drum. The image information is not askew on the drums or distorted. It should be noted that although the lines of image information on drum-sheet units 3D-G appear parallel with the axes of rotation of the drums, the lines of image information are actually slightly helical with respect to the axes. This is due to the fact that each drum is rotating while it is being scanned with the laser (see FIG. 1). However, because the laser scan rate is extremely high relative to the rate of rotation of the drums, the slight helical shape of the lines is not detectable by the naked eye and the lines of image information can be considered "essentially parallel" to the axes of rotation of the drums.

Additionally, each of drum-sheet units 3D-G had image information imparted to it in the same master-creating apparatus. This assists in ensuring that the image information is located in the same location on each drum. When these drum-sheet units are utilized in the xeroprinting apparatus of FIG. 2, the multicolor prints created therefrom will not contain any skew misregistration. It will not be necessary to reorient the master sheets on their respective drums.

The drums must be mounted the same in the two apparatus. This is much easier than precise orientation of a master sheet on a drum and does not require unusually precise structure. For example, the apparatus disclosed in the Landa patent for installing and securing a drum in a copier will accurately mount the drums the same in both the master-creating apparatus and the xeroprinting apparatus.

What is claimed is:

1. A method of xeroprinting comprising the steps of:

securing a master sheet to a drum to create a drum-sheet unit;

creating a xeroprinting master on said master sheet in a master-creating apparatus;

removing said drum-sheet unit from said master-creating apparatus;

installing said drum-sheet unit in a xeroprinting apparatus separate from said master-creating apparatus; and forming a plurality of xeroprints from said xeroprinting master in said xeroprinting apparatus.

2. A method of xeroprinting comprising the steps of:

securing at least two master sheets to at least two drums, one master sheet being secured to each drum, to create at least two drum-sheet units;

for each said drum-sheet unit:

(a) creating a color separation xeroprinting master on said master sheet in a master-creating apparatus; and (b) removing said drum-sheet unit from said master-creating apparatus;

installing said drum-sheet units in a xeroprinting apparatus; and forming a plurality of multicolor xeroprints from said color separation xeroprinting masters in said xeroprinting apparatus.

3. A method of xeroprinting as claimed in claim 2 wherein each said master sheet has an outer photoconductive layer next to a grounded conductive layer and wherein for each said drum sheet unit said creating step comprises:

charging said photoconductive layer to a uniform potential;

exposing said photoconductive layer to light according to color separation image data so as to selectively discharge said photoconductive layer and create a color separation electrostatic latent image;

developing said latent image with electrically insulating toner particles; and fusing said toner particles to said master sheet.

4. A method of xeroprinting as claimed in claim 3 wherein said forming step comprises the steps of:

(a) charging each such said master sheet to a uniform potential;

(b) flooding each said master sheet with light to create a color separation latent electrostatic image on each said master sheet;

(c) developing each said latent image with colored marking particles, a different color being used for each latent image, to create a visible color separation image on each said master sheet; and (d) transferring said visible color separation images to a receiver sheet in superimposed registration with one another to create a multicolor print.

5. A method of xeroprinting as claimed in claim 2 wherein each said master sheet has an outer layer comprised of an acid photogenerator next to a grounded conductive layer and wherein said creating step comprises:

exposing said acid photogenerating layer to light according to color separation image data such that a conductivity image is formed in the acid photogenerating layer.

6. A method of xeroprinting as claimed in claim 5 wherein said acid photogenerating layer is comprised of iodonium salt.

7. A method of xeroprinting as claimed in claim 6 wherein said forming step comprises the steps of:

(a) applying a uniform charge to each said master sheet, said charge remainig only on those areas of the iodonium salt layer not exposed to light;

(b) developing the remaining charge on each said master sheet with colored marking particles, a different color being used for each master sheet, to create a visible color separation image on each said master sheet; and (c) transferring said visible color separation images to a receiver sheet in superimposed registration with one another to create a multicolor print.

* * * * *